US007708376B2

(12) United States Patent
Hübler et al.

(10) Patent No.: US 7,708,376 B2
(45) Date of Patent: May 4, 2010

(54) DEVICE FOR CLEANING AN INKJET PRINTHEAD

(75) Inventors: Uwe Hübler, Neuenhagen (DE); Wolfgang Muhl, Hohen Neuendorf (DE); Wolfgang von Inten, Berlin (DE)

(73) Assignee: Francotyp Postalia GmbH, Birkenwerder (DE)

( * ) Notice: Subject to any disclaimer, the term of this patent is extended or adjusted under 35 U.S.C. 154(b) by 701 days.

(21) Appl. No.: 11/589,268

(22) Filed: Oct. 26, 2006

(65) Prior Publication Data

US 2007/0097173 A1 May 3, 2007

(30) Foreign Application Priority Data

Nov. 2, 2005 (DE) ..... 10 2005 052 150

(51) Int. Cl.
*B41J 2/165* (2006.01)

(52) U.S. Cl. ..... 347/33; 347/22; 347/30; 347/31; 347/35; 347/36

(58) Field of Classification Search ..... 347/22, 347/30, 31, 33, 35, 36
See application file for complete search history.

(56) References Cited

U.S. PATENT DOCUMENTS

| | | | | |
|---|---|---|---|---|
| 4,371,881 | A | 2/1983 | Bork et al. | |
| 5,806,994 | A | 9/1998 | Coffy et al. | |
| 5,883,648 | A * | 3/1999 | Hetzer | 347/33 |
| 6,224,187 | B1 * | 5/2001 | Inten et al. | 347/32 |
| 6,367,911 | B1 | 4/2002 | Windel et al. | |
| 6,389,327 | B1 * | 5/2002 | Thiel | 700/227 |
| 6,390,577 | B1 | 5/2002 | Fajour | |
| 6,477,511 | B1 | 11/2002 | Guenther | |
| 6,755,503 | B2 * | 6/2004 | von Niederhausern et al. | 347/33 |
| 2006/0017770 | A1 * | 1/2006 | Harada et al. | 347/36 |

FOREIGN PATENT DOCUMENTS

| | | | |
|---|---|---|---|
| DE | 144 24 771 | C1 | 11/1995 |
| DE | 196 05 014 | C1 | 3/1997 |
| DE | 197 57 653 | C2 | 6/1999 |
| DE | 197 26 642 | C1 | 9/1999 |
| DE | 200 12 946 | U1 | 10/2000 |
| DE | 100 62 012 | A1 | 2/2002 |
| EP | 0 041 706 | A2 | 12/1981 |
| EP | 0 696 509 | B1 | 9/1998 |
| EP | 0 799 135 | B1 | 3/1999 |
| EP | 1 332 881 | A2 | 8/2003 |
| JP | 05162334 | A * | 6/1993 |

* cited by examiner

*Primary Examiner*—Matthew Luu
*Assistant Examiner*—Kendrick X Liu
(74) *Attorney, Agent, or Firm*—Laurence A Greenberg; Werner H Stemer; Ralph E Locher

(57) ABSTRACT

A device cleans an inkjet printhead in a franking and/or addressing machine. The inkjet printhead is disposed in a stationary manner such that it can be pivoted in a printing window of a guide plate for the print carrier. A cleaning and sealing device is disposed behind the guide plate such that it can be displaced toward and away from the inkjet printhead. This improves the print quality, prolongs service life, and provides a high throughput rate. Spraying clear is possible both during the print carrier transport and in a rest position without the letter run being soiled. The cleaning and sealing device is disposed underneath the inkjet printhead to be displaced by an associated displacement device. A matched baffle piece is disposed underneath the inkjet printhead such that it can pivot and is coupled to the latter.

15 Claims, 8 Drawing Sheets

DEVICE FOR CLEANING AN INKJET PRINTHEAD

BACKGROUND OF THE INVENTION

Field of the Invention

The invention relates to a device for cleaning an inkjet printhead, in particular in a franking and/or addressing machine. It has proven worthwhile to utilize the advantages of inkjet printing in the area of mechanical franking and/or addressing as well. In this case, the printing is carried out without contact by an inkjet printhead, see for example German patent DE 44 24 771 C1 (corresponding to U.S. Pat. No. 6,367,911) and European patent EP 0 696 509 B1 (corresponding to U.S. Pat. No. 6,390,577). However, the inkjet printing technique has the disadvantage that more ink is used for cleaning the inkjet printhead than for the printing operation. This is particularly serious in the case of individual printing.

A franking machine is known in which the print carriers or letters are conveyed on edge, inclined beyond the vertical for reasons of stability, with the aid of a transport belt; in this regard see German patents DE 196 05 014 C1 (corresponding to U.S. Pat. No. 5,880,747) and DE 197 57 653 C2 (corresponding to U.S. Pat. No. 6,477,511). In this case, the letter is located behind a clear-view plate on a guide plate, in which a printing window is provided and in which the inkjet printhead is disposed in a stationary manner such that its nozzle surface is disposed parallel to the guide plate. The letter is led past the printing window and the inkjet printhead and, during this, is printed on the side facing away from the viewer.

The problem of inkjet printhead cleaning and sealing is in this case solved by a device for cleaning the inkjet printhead, see European patent EP 0 799 135 B1, in which the inkjet printhead is fixed such that it can be pivoted alternatively from a printing position into a cleaning position and/or sealing position and back again, and the cleaning and sealing device is disposed such that it can be displaced linearly toward the inkjet printhead and away from the latter again.

The cleaning and sealing device contains a sealing cap matched to the inkjet printhead and having suction slots for each row of nozzles and a wiping lip that can be displaced transversely, as well as a downstream suction pump. Also provided in the sealing cap, at one end, is an extraction region having a suction opening for the wiping lip. The wiping lip is displaced by a spindle drive.

As an addition to this, a device for positioning an inkjet printhead and a cleaning and sealing device are known, see German patent DE 197 26 642 C1 (corresponding to U.S. Pat. No. 6,224,187), in which, for the displacement of the inkjet printhead and the cleaning and sealing device, a common gear mechanism is provided which is driven by a motor which runs in only one direction of rotation. The inkjet printhead, the cleaning and sealing device and the entire gear mechanism including motor are fixed in a common frame and in this way are combined to form a compact subassembly. This subassembly is in turn adjustably fixed to the transport device. The inkjet printhead can be pivoted by more than 90° from the printing position into the cleaning position and back again. The cleaning and sealing device is disposed underneath the inkjet printhead such that it can be displaced linearly vertically. During the cleaning operation, the cleaning and sealing device is docked on the inkjet printhead pivoted downwards. Accordingly, the procedure is also the same during spraying clear.

With the solutions described above, the letter transport is interrupted during the cleaning process and, accordingly, the letter throughput is reduced. In the event of spraying clear operation in the printing position during the letter transport, either the letter or the letter run—clear-view plate, transport belt—is noticeably soiled.

On the other hand, a franking machine having an inkjet printhead is known, see European patent EP 0 696 509 B1 (corresponding to U.S. Pat. No. 6,390,577) and U.S. Pat. No. 5,806,994, in which the letters are transported lying horizontally and the nozzle surface is disposed parallel thereto. In this machine, the nozzles that are used a little or not used during the printing are sprayed clear as long as there is no letter present in front of the printhead. For this purpose, the letter transport device is provided with appropriate cutouts and a collecting container for the ink sprayed clear is disposed underneath the same. The ink consumption is reduced in this way but the horizontal letter transport is a precondition for this.

SUMMARY OF THE INVENTION

It is accordingly an object of the invention to provide a device for cleaning an inkjet printhead which overcomes the above-mentioned disadvantages of the prior art devices of this general type, which improves the print quality, prolongs the service life of the printing device, and provides the highest possible letter throughput.

With the foregoing and other objects in view there is provided, in accordance with the invention, a franking and/or addressing machine. The machine contains a guide plate having a printing window, an inkjet printhead disposed in a stationary manner and is pivotable behind the guide plate in the printing window, and a transport device for guiding a print carrier along in contact and standing on one edge by the transport device. A cleaning and sealing device is disposed behind the guide plate and underneath the inkjet printhead. A first displacement device is provided for pivoting the inkjet printhead into a printing position, into various cleaning regions, and into a sealing position. A second displacement device is provided for displacing the cleaning and sealing device toward the inkjet printhead and away from the inkjet printhead. A pivotably mounted matched baffle piece is disposed underneath the inkjet printhead and is coupled to the inkjet printhead. A common ink sump is disposed underneath all of the above components.

In the device for cleaning an inkjet printhead in a franking and/or addressing machine, in which the letters are transported standing on one edge and the inkjet printhead is disposed in a stationary manner behind a guide plate such that it can be pivoted, and in which, in addition to the usual functions such as wiping and sealing, a spraying clear function is possible both during the letter transport and also in the rest position without the letter run being soiled.

In accordance with an added feature of the invention, the inkjet printhead has a nozzle surface and the guide plate is inclined beyond a vertical. The inkjet printhead is disposed such that the inkjet printhead can be pivoted appropriately by more than 85° from the printing position, in which the nozzle surface is disposed parallel to the guide plate, to an end of an outermost cleaning region and back again. Stops are provided including a first stop and a second stop defining pivot positions of the inkjet printhead. The inkjet printhead is an integral constituent part of a printing module, the printing module being inserted into a module holder.

In accordance with another feature of the invention, the cleaning and sealing device has a device holder with wiping lips, a spray duct, and sealing caps. All of these components are disposed in the order cited behind the guide plate.

In accordance with a further feature of the invention, the first displacement device includes a worm gear mechanism, an actuating motor and a rotary encoder for displacing the module holder and, consequently, also the inkjet printhead. In the printing position, the inkjet printhead is fixed by the first stop, and in an end position the inkjet print head is fixed by the second stop in the outermost cleaning region, the stops being used to calibrate the rotary encoder. The sealing position is fixed by the rotary encoder in accordance with a predefined setting wherein the nozzle surface is disposed orthogonally with respect to the wiping lips of the cleaning and sealing device. Sensors are provided for triggering various positions of the inkjet printhead, the sensors are disposed in a region of a letter run and linked to a control computer.

In accordance with an additional feature of the invention, the second displacement device for displacing the cleaning and sealing device has a spindle gear mechanism, an actuating motor, a guide shaft and a further sensor for defining a reference point setting.

In accordance with a further added feature of the invention, a holder is provided. The inkjet printhead is resiliently and kinematically coupled via the holder to the matched baffle piece, the matched baffle piece being configured as a shell.

In accordance with another additional feature of the invention, a wheel is fixed to the module holder holding the printing module such that the module holder can rotate. A guide edge is integrally molded on an outside of the matched baffle piece, the matched baffle piece is connected to the module holder via a tension spring. The wheel bears with a force on the guide edge and, with the guide edge, forms a slotted guide for the matched baffle piece.

In accordance with yet another feature of the invention, the common ink sump has a device holder being open at a front, an insert with a nonwoven and a securing clip, guided in the device holder. The device holder further has a handle for allowing easy replaceability.

In accordance with the invention, in a first cleaning region, for performing a spraying clear function, the inkjet printhead is pivoted so far away from the printing position that there is at least twice a distance from the print carrier but all ink drops still reach the print carrier. In a second cleaning region, for performing a spraying clear function, the inkjet printhead is pivoted so far away from the printing position that all ink drops already or still strike the matched baffle piece. In a third cleaning region, for performing a spraying clear function, the inkjet printhead is pivoted so far away from the printing position that all ink drops strike the nonwoven directly, and this also defines a position in which the spraying clear is carried out through the spray duct. In a fourth cleaning region, for performing a wiping function, the inkjet printhead is pivoted so far away from the printing position that the nozzle surface is disposed in an engagement region of the wiping lips.

In accordance with a further added feature of the invention, a carrier with wipers is provided for cleaning the wiping lips, the carrier is disposed in a stationary manner in an engagement region of the wiping lips.

In accordance with a concomitant feature of the invention, for assuming a sealing position, the inkjet printhead is docked on the cleaning and sealing device being previously positioned, and therefore on the sealing caps, coming from the fourth cleaning region, and is undocked going into the same.

Other features which are considered as characteristic for the invention are set forth in the appended claims.

Although the invention is illustrated and described herein as embodied in a device for cleaning an inkjet printhead, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
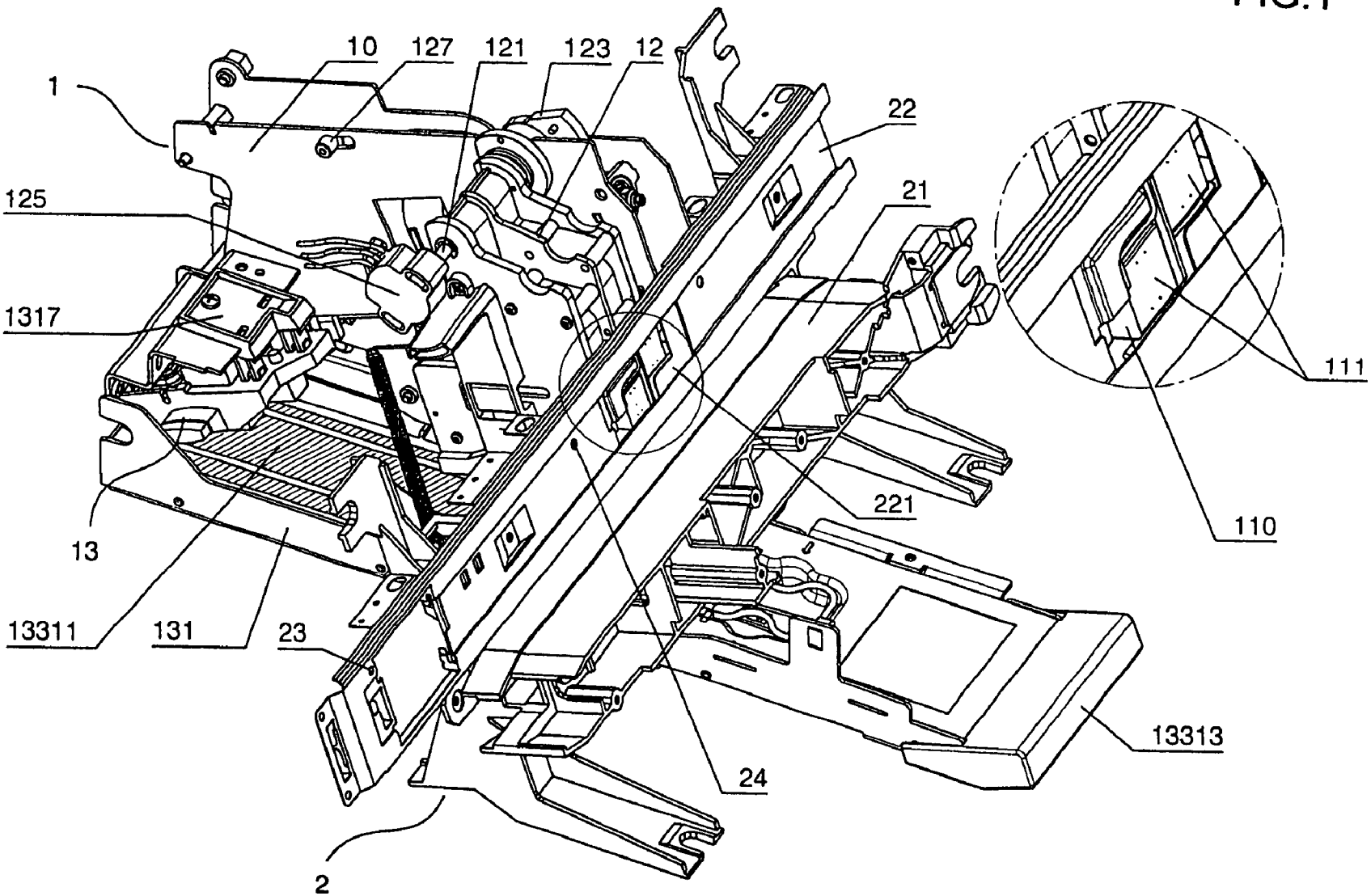
FIG. 1 is a front, left perspective view of a printing system in a printing position I in a franking machine having a cleaning and sealing device and a transport device according to the invention.

Referring now to the figures of the drawing in detail and first, particularly, to FIG. 1 thereof, there is shown schematically a franking machine having a printing system 1 and a guide plate 22 having a printing window 221, in which two inkjet printheads 110 are disposed in a stationary manner. The guide plate 22 is a constituent part of a transport device 2 having a drive part 21 and two sensors 23, 24. Sensor 23 is at a "start position" and is disposed upstream in the letter run at the start of the transport device 2 and is used to register and signal incoming letters. Sensor 24 is at "print position" and is disposed downstream in the letter run direction in front of the printing window 221 and is used to register letters located on the transport device 2 and to trigger and terminate the printing command. The two sensors 23, 24 and the drive part 21 are connected to a control computer 3 for the franking machine; see also FIG. 9.

Figure 2:
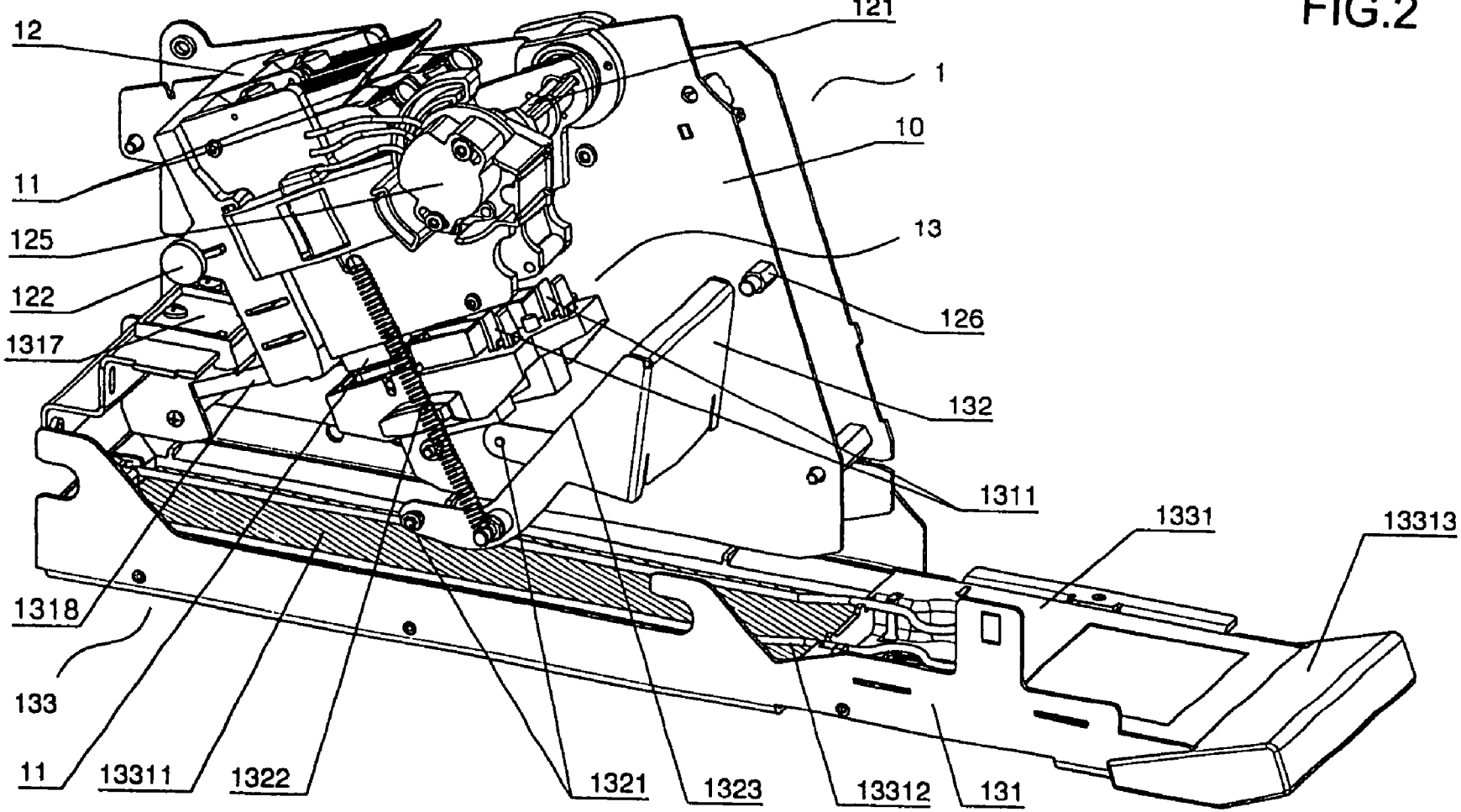
FIG. 2 is a front, left perspective view of the printing system in a sealing position VI in the franking machine having the cleaning and sealing device.

The printing system 1 contains a frame 10, two printing modules 11, a holder 12 for the aforementioned two and an associated cleaning and sealing device; see also FIG. 2. Each printing module 11 contains an inkjet printhead 110 together with ink supply and control circuit board—not designated. Nozzle surfaces 111 of the inkjet printheads 110 and of the printing modules 11 are disposed parallel to the guide plate 22 but offset in relation to each other in the printing window 221 when in a printing position I—angle 0 degrees. In this way, the necessary printing gap length is achieved. Accordingly, the printing modules 11 are disposed offset in the holder 12.

The holder 12 is mounted such that it can pivot about an axle 121, which is fixed in the frame 10. The displacement of the holder 12 is carried out by an actuating motor 124 via a worm gear mechanism 123; in this regard see also FIG. 3. A drive action is provided by the control computer 3 of the franking machine on the basis of a rotary encoder 125; in this regard see also FIG. 9.

Figure 7:
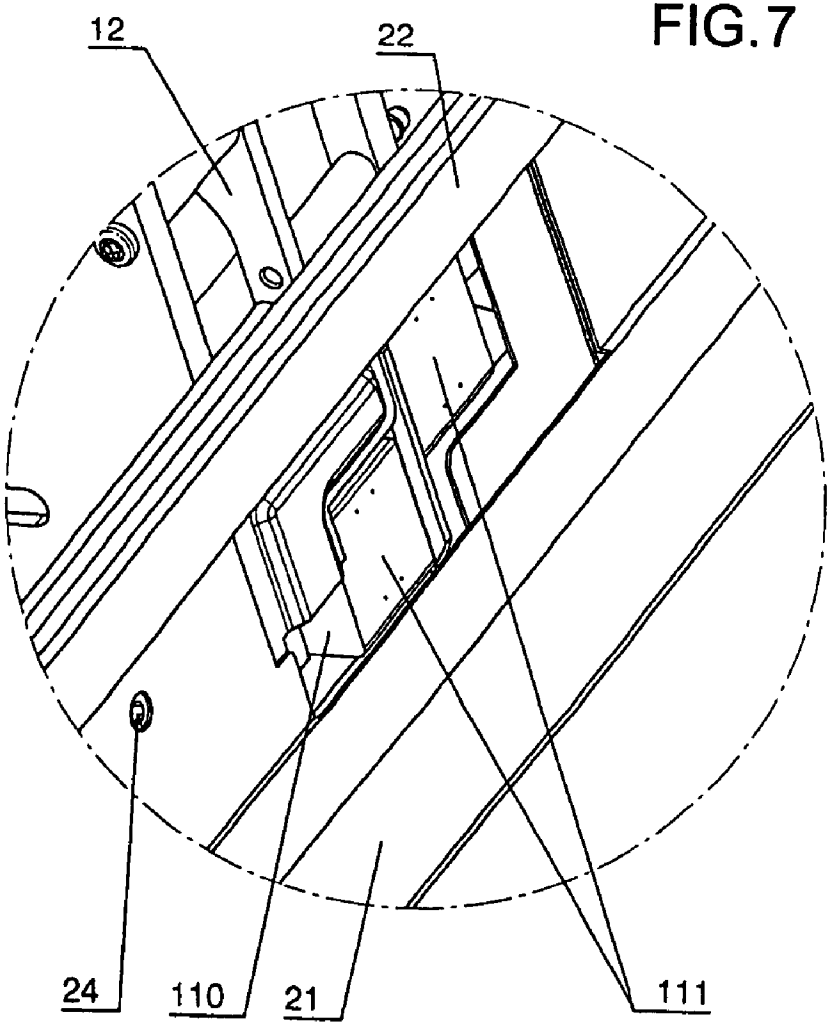
FIG. 7 is a detailed, partial front view of the printing system in the printing position I.

Provided on the frame 10 are two stops 126, 127, which limit the pivoting range of the holder 12. The stop 126 is used to fix the printing position I, which is at the same time the first calibration position for the rotary encoder 125; in this regard see FIGS. 2, 3 and 7. The stop 127 is used to fix the outermost position in the cleaning region V, which is the second calibration position for the rotary encoder 125 and, in addition, a wiping position. Since the angle—85 degrees—between the two stops 126, 127 is predefined by the design, the rotary encoder 125 can be calibrated on this basis for the purpose of setting the various cleaning regions II, III, IV and V and also the sealing position VI; in this regard see also FIG. 5. Therefore, individual deviations of the rotary encoder 125 are eliminated.

Explanations relating to the cleaning regions follow further below.

Figure 5:
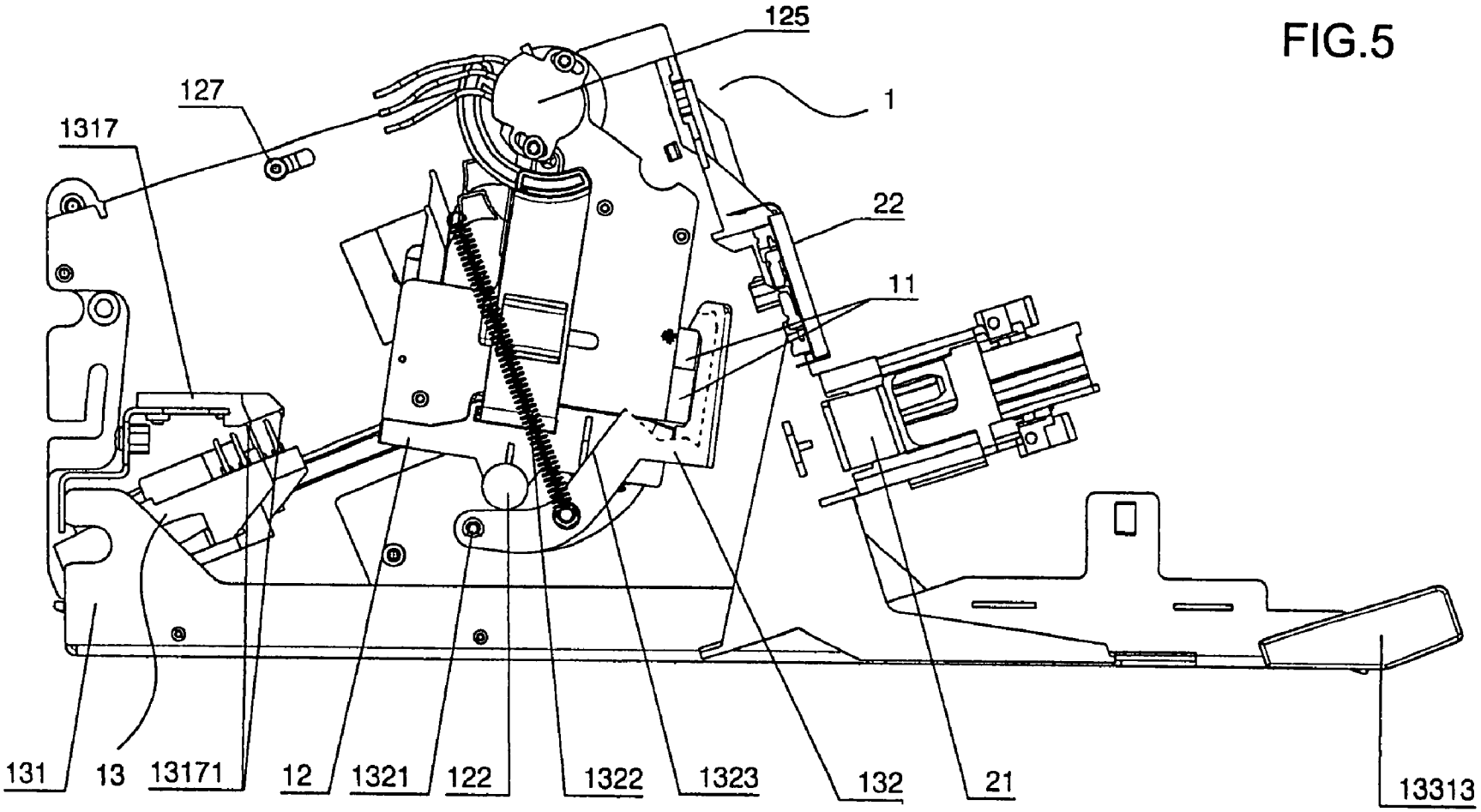
FIG. 5 is a diagrammatic, left side view of the printing system in the second cleaning region III for a spraying clear function against a baffle piece.

According to FIGS. 2 and 5, both inkjet printheads 110 are resiliently and kinematically coupled to a common baffle piece 132, which is configured in the manner of a shell. For this purpose, a wheel 122 is fixed to the holder 12 of the printing modules 11 such that it can rotate, and a guide edge 1323 is integrally molded on the outside of the baffle piece 132, and the baffle piece 132 is connected to the holder 12 via a tension spring 1322. As a result, the wheel 122 bears with a force on the guide edge 1323 and, with the latter, forms a slotted guide for the baffle piece 132.

Figure 3:
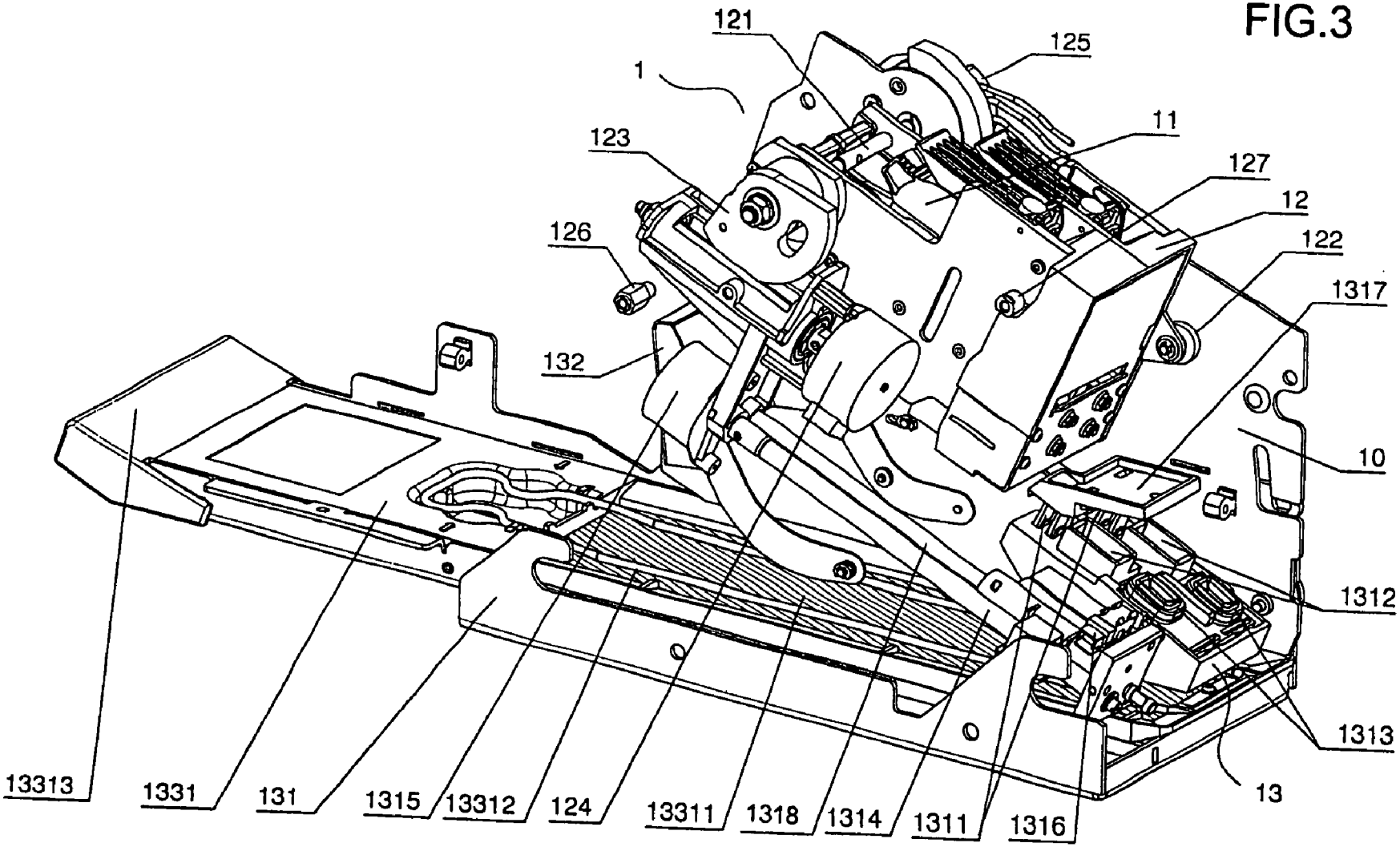
FIG. 3 is a rear left perspective view of the printing system in the printing position I in the franking machine having the cleaning and sealing device.
Figure 4:
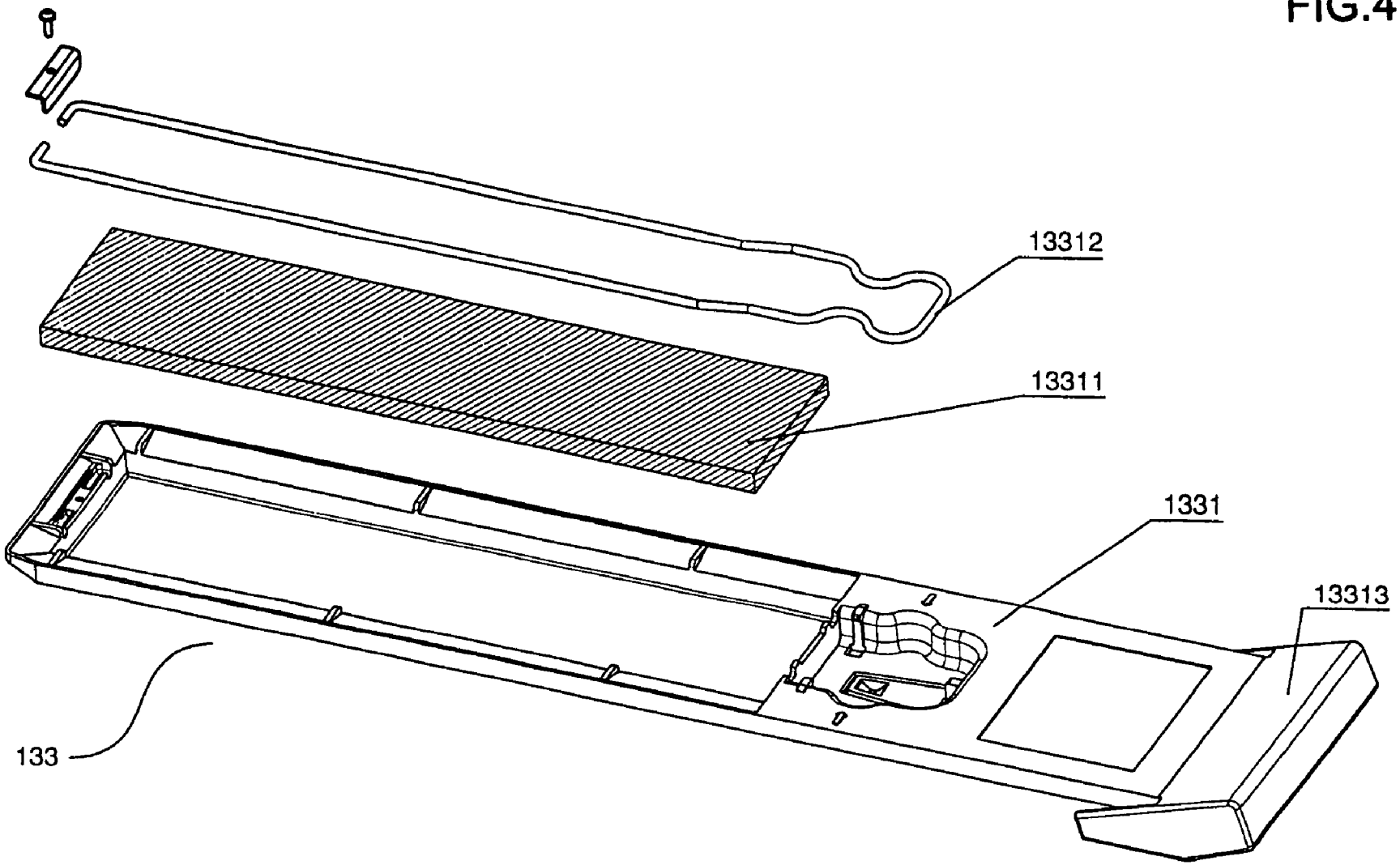
FIG. 4 is a diagrammatic, exploded perspective view of the insert for an ink sump.
Figure 6:
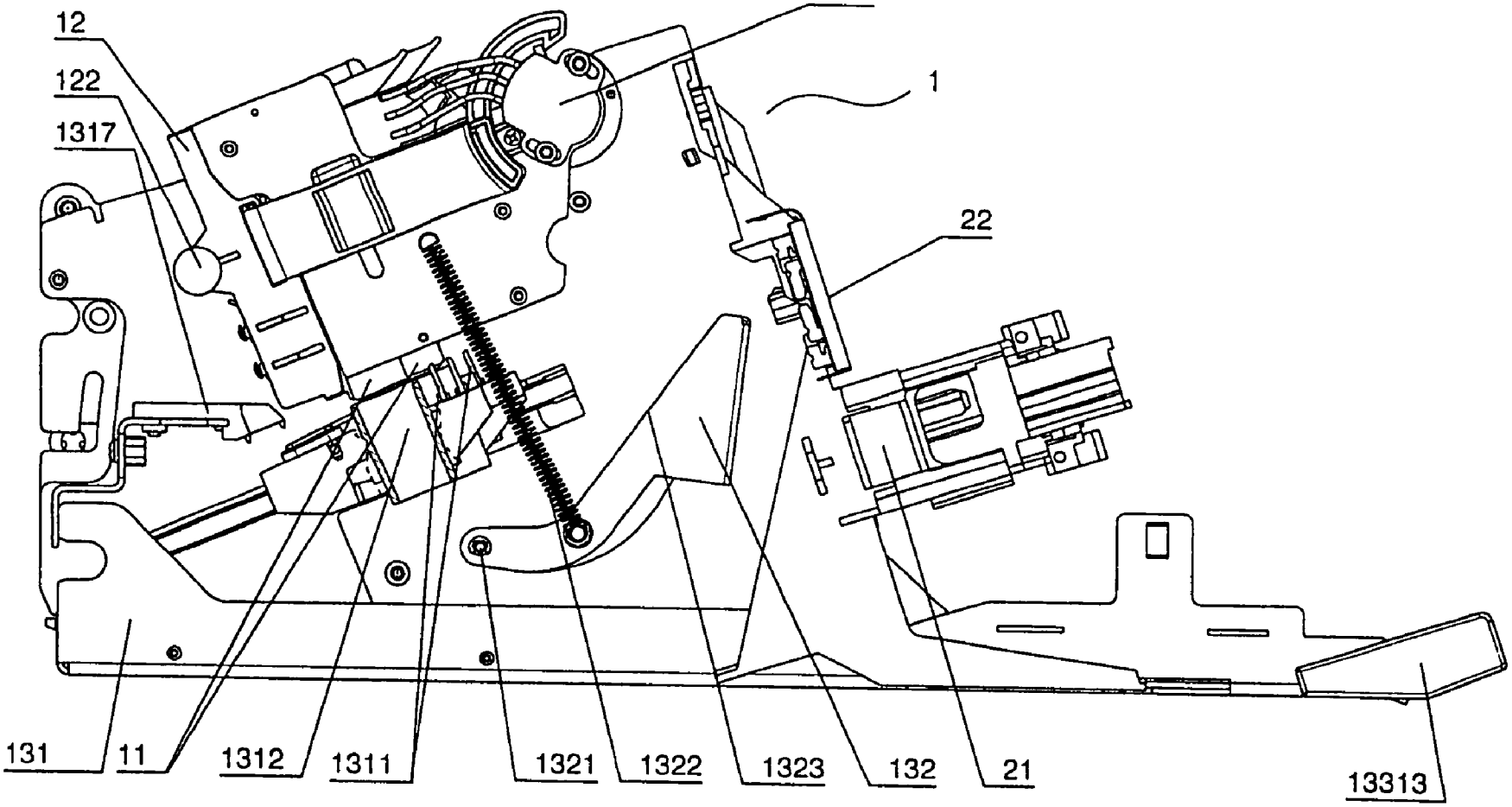
FIG. 6 is a diagrammatic, left side view of the printing system in the third cleaning region for spraying clear in the spray duct.
Figure 8:
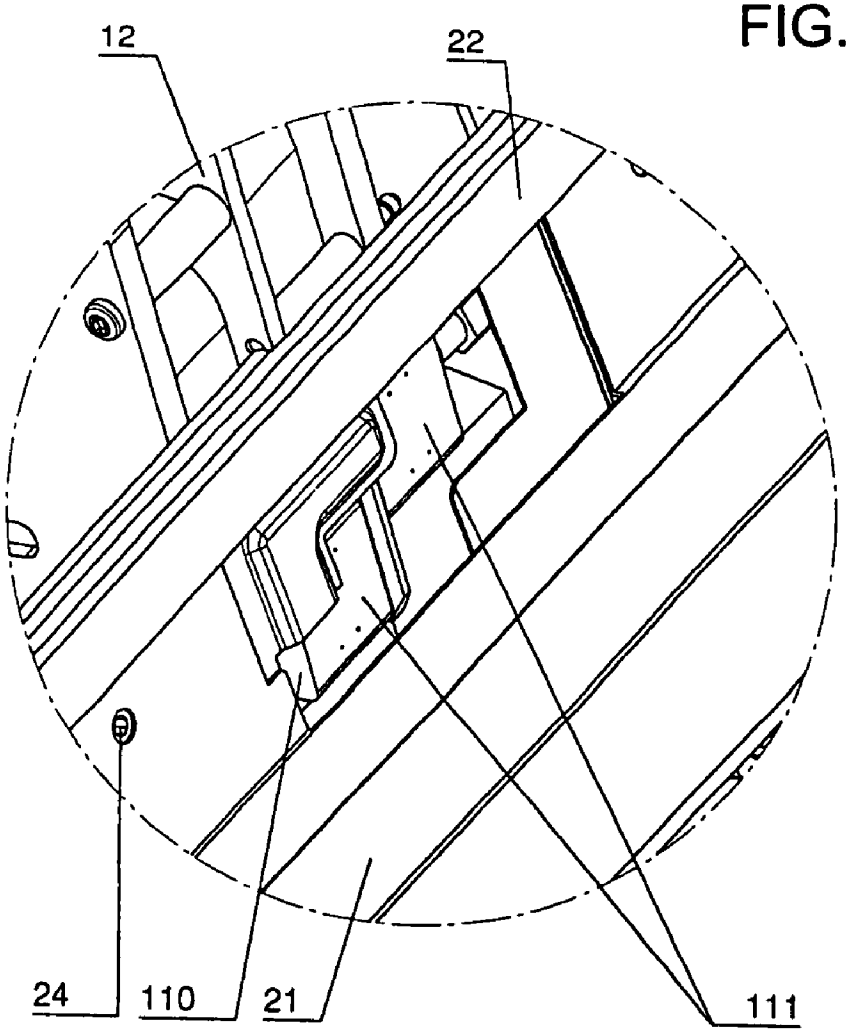
FIG. 8 is a detailed, partial front view of the printing system in the first cleaning region II.

A cleaning and sealing device 13 has a holder 131 with wiping lips 1311, a spray duct 1312 and sealing caps 1313, which are disposed in the order cited behind the guide plate 22; see also FIGS. 2, 3 and 6.

For the displacement of the cleaning and sealing device 13, a spindle gear mechanism 1314 together with guide shaft 1318 and an actuating motor 1315 and a sensor 1316 for the reference point setting are provided; in this regard see FIGS. 2 and 3. The sensor 1316 and the actuating motor 1315 are linked electrically to the control computer 3; see FIG. 9.

In order to clean the wiping lips 1311, a carrier 1317 with wipers 13171 is provided, which is disposed in a stationary manner in the engagement region of the wiping lips 1311; in this regard see FIGS. 3 and 5.

An ink sump 133 is formed from an insert 1331 having a nonwoven 13311 and a securing clip 13312. The insert 1331 is guided in the holder 131 open at the front and, for the purpose of easier replaceability, is provided with a handle 13313; in this regard see FIGS. 1 to 5.

While the printing position I and the sealing position VI are determined by uniquely defined positions of the inkjet printhead 110 and the cleaning and sealing device 13, the cleaning regions II to V, as the name already states, can be adjusted smoothly continuously. The sealing position VI is fixed in accordance with a predefined setting by the rotary encoder 125 such that the nozzle surface 111 is disposed orthogonally with respect to the wiping lips 1311 of the cleaning and sealing device 13.

Figure 9:
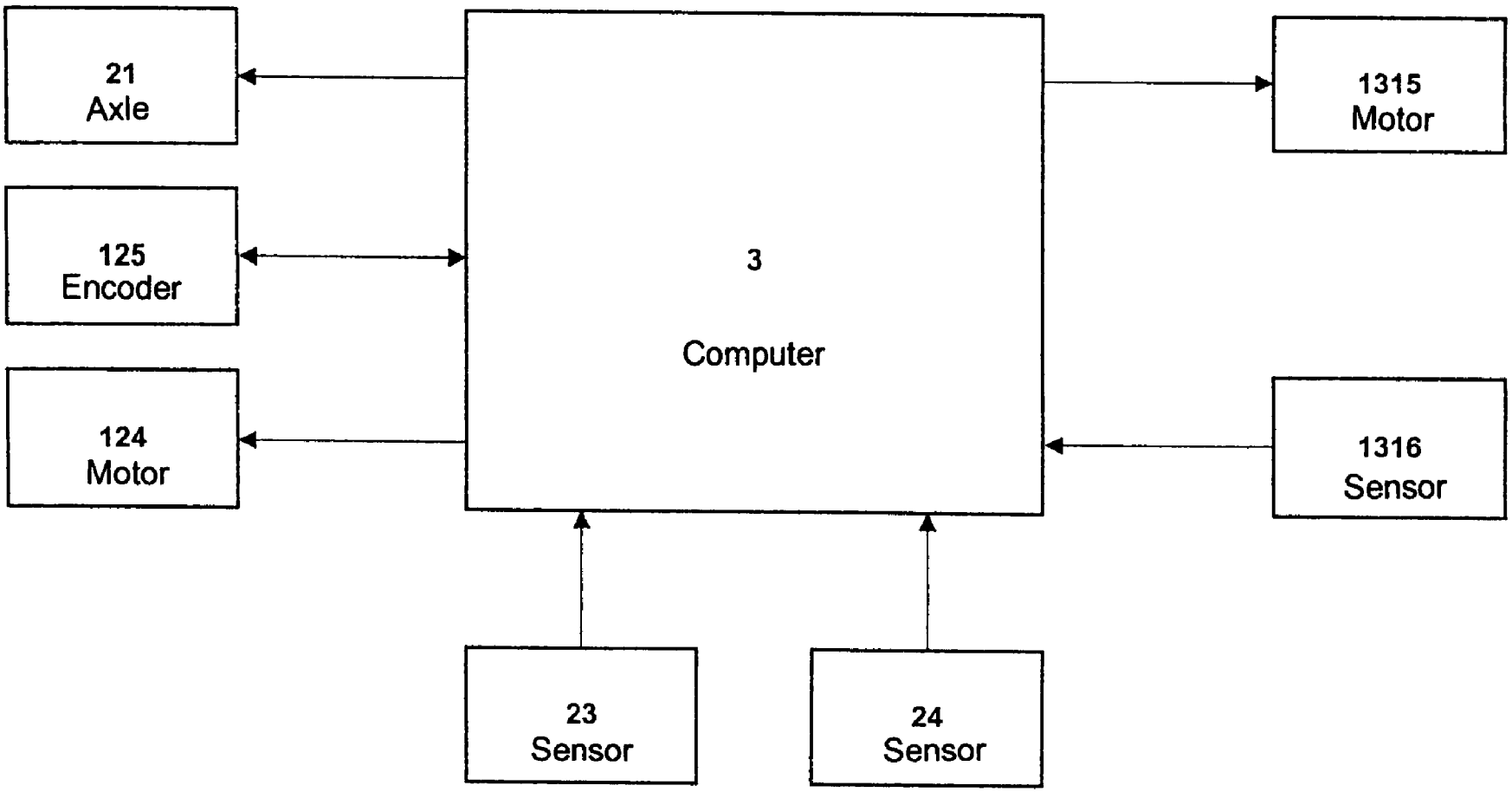
FIG. 9 is a block diagram relating to the link between sensors of a transport device, a control computer and the printing system and also the cleaning and sealing device.

For triggering the various positions of the inkjet printhead 110 and of the cleaning and sealing device 13, the sensors 23, 24 disposed in the letter run and the sensor 1316 for the reference point setting are linked to the control computer 3; see FIG. 9. In a first cleaning region II, for the purpose of performing a spraying clear function, the inkjet printhead 110 is pivoted so far away from the printing position I that there is at least twice the distance from the letter or print carrier but all the ink drops still reach the letter. Here, use is made of the effect that, beginning from twice the envisaged printing distance, the inkjet print drops break up into correspondingly smaller satellite drops whose scattering range is so great that a detectable printing pattern is no longer provided.

In the second cleaning region III, for the purpose of performing a spraying clear function, the inkjet printhead 110 is pivoted so far away from the printing position I that no ink drops reached the letter any more and all the ink drops already or still strike the baffle piece 132.

In the third cleaning region IV, for the purpose of spraying clear, the inkjet printhead 110 is pivoted so far away from the printing position I that all the ink drops strike the nonwoven 13311 directly. This also includes the position in which spraying clear is carried out through the spray duct 1312.

As emerges from the above explanations, as distinct from the prior art, in the cleaning regions II to IV the time in which the inkjet printhead 110 is moving is also advantageously used for spraying clear, which shortens the downtimes substantially.

In the fourth cleaning region V, the inkjet printhead 110 is pivoted so far away from the printing position I that the nozzle surface 111 is disposed in the engagement region of the wiping lips 1311.

In order to assume the sealing position VI, the inkjet printhead 110 is docked on the previously positioned cleaning and sealing device 13 and therefore on the sealing caps 1313, coming from the fourth cleaning region V, and is undocked going into the same.

This application claims the priority, under 35 U.S.C.§119, of German patent application DE 10 2005 052 150.9, filed Nov. 2, 2005; the entire disclosure of the prior applications are herewith incorporated by reference.

We claim:

1. A franking and/or addressing machine, comprising:

a guide plate having a printing window formed therein;

an inkjet printhead disposed in a stationary manner and being pivotable behind said guide plate in said printing window;

a transport device for guiding a print carrier along in contact and standing on one edge by said transport device;

a cleaning and sealing device disposed behind said guide plate and underneath said inkjet printhead;

a first displacement device for pivoting said inkjet printhead into a printing position, into a plurality of cleaning positions corresponding to various cleaning regions, and into a sealing position;

a second displacement device for displacing said cleaning and sealing device toward said inkjet printhead and away from said inkjet printhead;

a pivotably mounted matched baffle piece disposed underneath said inkjet printhead and coupled to said inkjet printhead; and a common ink sump disposed underneath all of the above components.

2. The machine according to claim 1, wherein said inkjet printhead has a nozzle surface;

wherein said guide plate is inclined beyond a vertical and said inkjet printhead is disposed such that said inkjet printhead can be pivoted appropriately by more than 85° from the printing position, in which said nozzle surface is disposed parallel to said guide plate, to an end of an outermost cleaning region and back again; and further comprising stops including a first stop and a second stop defining pivot positions of said inkjet printhead;

further comprising a module holder; and wherein said inkjet printhead being an integral constituent part of a printing module, said printing module being inserted into said module holder.

3. The machine according to claim 2, wherein said cleaning and sealing device has a device holder with wiping lips, a spray duct and sealing caps, and are all disposed in the order cited behind said guide plate.

4. The machine according to claim 2, wherein said first displacement device includes a worm gear mechanism, an actuating motor and a rotary encoder for displacing said module holder and, consequently, also said inkjet printhead, and in the printing position, said inkjet printhead is fixed by said first stop, and in an end position said inkjet print head is fixed by said second stop in the outermost cleaning region, said stops being used to calibrate said rotary encoder, and in that a sealing position is fixed by said rotary encoder in accordance with a predefined setting wherein said nozzle surface is disposed orthogonally with respect to said wiping lips of said cleaning and sealing device; and further comprising sensors for triggering various positions of said inkjet printhead, said sensors disposed in a region of a letter run and linked to a control computer.

5. The machine according to claim 1, wherein said second displacement device for displacing said cleaning and sealing device has a spindle gear mechanism, an actuating motor, a guide shaft and a further sensor for defining a reference point setting.

6. The machine according to claim 1, further comprising a holder, said inkjet printhead being resiliently and kinematically coupled via said holder to said matched baffle piece, said matched baffle piece being configured as a shell.

7. The machine according to claim 2, further comprising:

a wheel being fixed to said module holder holding said printing module such that said module holder can rotate;

a tension spring; and a guide edge integrally molded on an outside of said matched baffle piece, said matched baffle piece connected to said module holder via said tension spring, said wheel bears with a force on said guide edge and, with said guide edge, forms a slotted guide for said matched baffle piece.

8. The machine according to claim 3, wherein said common ink sump has said device holder being open at a front, an insert with a nonwoven and a securing clip, guided in said device holder and, said device holder having a handle for allowing easy replaceability.

9. The machine according to claim 1, wherein, in a first cleaning region, for performing a spraying clear function, said inkjet printhead is pivoted away from the printing position to at least twice the printing distance from the print carrier but such that all ink drops still reach the print carrier.

10. The machine according to claim 1, wherein, in a second cleaning region, for performing a spraying clear function, said inkjet printhead is pivoted so far away from the printing position that all ink drops already or still strike said matched baffle piece.

11. The machine according to claim 8, wherein, in a third cleaning region, for performing a spraying clear function, said inkjet printhead is pivoted so far away from the printing position that all ink drops strike said nonwoven directly, and this also defines a position in which the spraying clear is carried out through said spray duct.

12. The machine according to claim 3, wherein in a fourth cleaning region, for performing a wiping function, said inkjet printhead is pivoted so far away from the printing position that said nozzle surface is disposed in an engagement region of said wiping lips.

13. The machine according to claim 3, further comprising:

a carrier with wipers for cleaning said wiping lips, said carrier disposed in a stationary manner in an engagement region of said wiping lips.

14. The machine according to claim 12, wherein for assuming a sealing position, said inkjet printhead is docked on said cleaning and sealing device being previously positioned, and therefore on said sealing caps, coming from the fourth cleaning region, and is undocked going into the same.

15. In a franking and/or addressing machine containing a guide plate having a printing window formed therein, an inkjet printhead disposed in a stationary manner and being pivotable behind the guide plate in the printing window, a transport device for guiding a print carrier along in contact and standing on one edge by the transport device, and a cleaning and sealing device disposed behind the guide plate and underneath the inkjet printhead, a device for cleaning the inkjet printhead, the device comprising:

a first displacement device for pivoting the inkjet printhead into a printing position, into a plurality of cleaning positions corresponding to various cleaning regions, and into a sealing position;

a second displacement device for displacing the cleaning and sealing device toward the inkjet printhead and away from the inkjet printhead;

a pivotably mounted matched baffle piece disposed underneath the inkjet printhead and coupled to the inkjet printhead; and a common ink sump disposed underneath all of the above components.

* * * * *